US006018828A

United States Patent [19]

Loschelder

[11] Patent Number: 6,018,828

[45] **Date of Patent: *Feb. 1, 2000**

[54] REVERSIBLE EXTENSION NUT FOR SIDE SPRAY ESCUTCHEONS

[75] Inventor: Todd C. Loschelder, Macedonia, Ohio

[73] Assignee: Moen Incorporated, North Olmsted, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/949,963

[22] Filed: Oct. 14, 1997

[51] Int. Cl.[7] ..... E03C 1/042

[52] U.S. Cl. ..... 4/695; 4/675; 411/427

[58] Field of Search ..... 4/675–678, 695; 411/427, 435, 437; 137/801

[56] References Cited

U.S. PATENT DOCUMENTS

| | | | |
|---|---|---|---|
| 1,398,604 | 11/1921 | Schweinert | 411/427 |
| 2,355,736 | 8/1944 | Klein . | |
| 2,552,794 | 5/1951 | Kimbell | 411/427 |
| 2,632,355 | 3/1953 | Becker . | |
| 3,029,831 | 4/1962 | Leete . | |
| 3,067,436 | 12/1962 | Freibott | 4/675 |
| 3,079,830 | 3/1963 | Faroni et al. | 411/427 |
| 3,118,464 | 1/1964 | McClenahan . | |
| 3,319,509 | 5/1967 | Romeo | 411/435 |
| 3,376,888 | 4/1968 | Anthony | 4/695 |
| 4,435,111 | 3/1984 | Mizusawa | 411/435 |
| 4,470,736 | 9/1984 | Tasseron . | |
| 4,502,165 | 3/1985 | Szemeredi et al. . | |
| 4,747,428 | 5/1988 | Crawford et al. . | |
| 5,135,022 | 8/1992 | Kovey et al. . | |
| 5,139,380 | 8/1992 | Reynolds | 411/437 |

FOREIGN PATENT DOCUMENTS

| | | | |
|---|---|---|---|
| 597222 A1 | 5/1994 | European Pat. Off. | 4/695 |

*Primary Examiner*—Charles R. Eloshway
*Attorney, Agent, or Firm*—Dorn, McEachran, Jambor & Keating

[57] ABSTRACT

A dual position fastener for use in attaching a plumbing fitting having an exteriorly threaded conduit to sink decks of varying thickness has an elongated, generally cylindrical body with an interior bore. The bore is threaded. There is a radial extension at one end of the elongated body with the radial extension having oppositely facing generally parallel surfaces, which surfaces are essentially normal to the axis of the bore. One of the parallel surfaces is at the end of the fastener, with the other of the parallel surfaces being axially spaced from the one end. Each radial surface is adapted to abut the underside of a sink deck when the fastener is used in attaching a plumbing fitting. The one radial surface abuts the underside of a sink deck and the elongated body extends away from the sink deck in one position or use of the fastener, with the other radial surface abutting the underside of a sink deck and the elongated body extending toward the sink deck in a second position or use of the fastener.

3 Claims, 1 Drawing Sheet

Fig. 1.
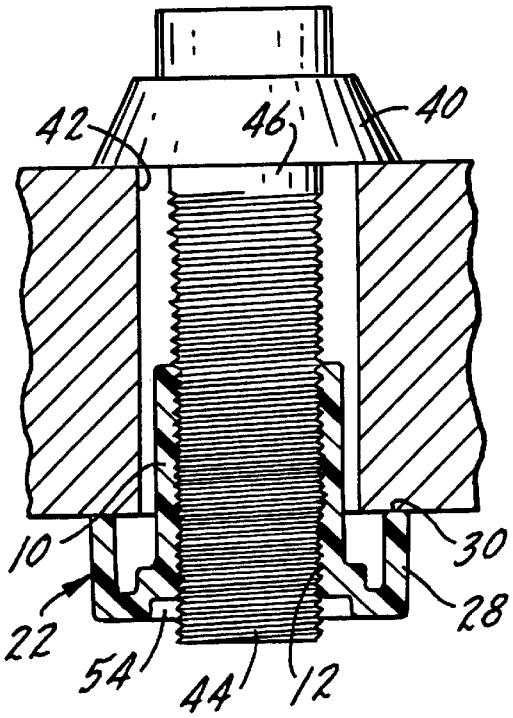
Fig. 2.
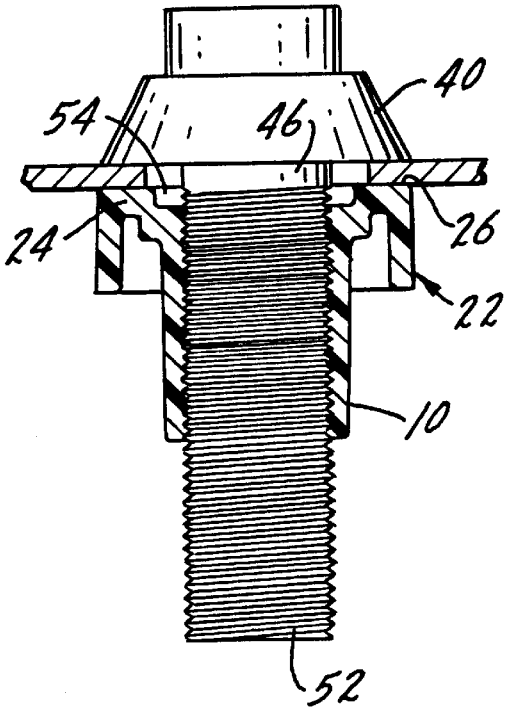
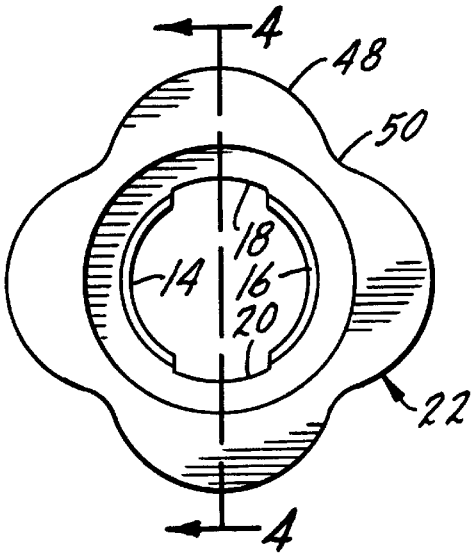
Fig. 3.
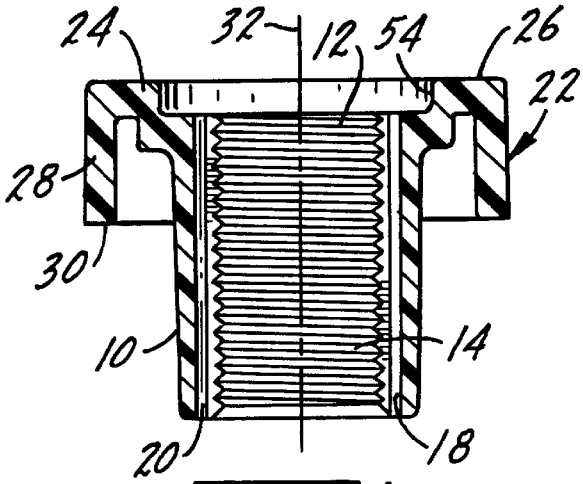
Fig. 4.

REVERSIBLE EXTENSION NUT FOR SIDE SPRAY ESCUTCHEONS

THE FIELD OF THE INVENTION

The present invention relates to fasteners for use in attaching plumbing fittings to a sink deck and more specifically, to a fastener which has a dual use in attaching a kitchen side spray to the sink deck. Kitchen decks are provided in varying thickness from a maximum of approximately 2" to a minimum of somewhat less than 1". Current side spray attachments only allow for a maximum deck thickness of 1-⅛". The present invention provides a dual position or dual use side spray attachment fastener which can accommodate sink decks of varying thickness.

SUMMARY OF THE INVENTION

The present invention relates to an extension nut for use in attaching side sprays to sink decks and more particularly to an extension nut which may be used in two different positions to accommodate sink decks of varying thickness.

A primary purpose of the invention is a dual use extension nut for attaching plumbing fittings having a threaded conduit.

Another purpose is an extension nut which is reliable, simple in construction and capable of attaching plumbing fittings such as side sprays to sink decks of varying thickness.

Other purposes will appear in the ensuing specification, drawings and claims.

BRIEF DESCRIPTION OF THE DRAWINGS

The invention is illustrated diagrammatically in the following drawings wherein:

Fig. 1 is an axial section through a sink deck showing the extension nut in one position of use;

Fig. 2 is an axial section, similar to FIG. 1, showing the extension nut in a second position of use;

Fig. 3 is a top view of the extension nut; and

Fig. 4 is a section along plane 4—4 of FIG. 3.

DESCRIPTION OF THE PREFERRED EMBODIMENT

Most plumbing fittings and particularly kitchen deck side sprays have a threaded conduit and a nut is attached to the conduit and threaded up against the bottom of the sink deck to attach the fitting to the deck. Sink decks are not uniform in thickness and may vary from as much as 2" to substantially less than 1". Particularly in thin sink decks, current fasteners which are threaded throughout their length are not usable in that the fastener may abut against an unthreaded portion of the conduit, with the result that there is not a firm mounting of the side spray to the kitchen deck. The present invention provides a dual use extension nut which may accommodate sink decks of varying thickness and will attach plumbing fittings such as side sprays for kitchen decks up to 2" in thickness and sink decks substantially less than 1" in thickness.

The extension nut includes a body 10 which may be generally cylindrical and has an interior bore 12. The bore 12 is threaded, as particularly shown in FIG. 3, with the threads being discontinuous. There are two diametrically opposed arcuate thread segments indicated at 14 and 16 which constitute the interior thread for the bore. The thread will be in the typical spiral configuration, but it is discontinuous in that there are gaps 18 and 20 between the arcuate threaded segments 14 and 16. Such a thread configuration is particularly easy to manufacture in that the threads may be formed by a collapsible threading tool.

The extension nut has a radial extension indicated generally at 22 which is at one end of the body 10. The radial extension 22 has a radial portion 24 having a surface 26 which will abut the underside of the sink deck when the nut is used on thin decks as exemplified by the arrangement of FIG. 2. The extension 22 has an axial portion 28 which terminates in a surface 30 which will abut the underside of the sink deck when the nut is used in the mounting configuration of FIG. 1. The surfaces 26 and 30 are generally parallel and they are both essentially normal to the axis 32 of the threaded bore 12.

The extension nut may be formed of a suitable plastic such as polypropylene, which may be in part glass filled, or it may be formed of metal. Plastic is preferred.

In the use illustrated in FIG. 1, the sink deck may have a thickness of approximately 2". The escutcheon of the side spray is indicated at 40 and extends over an opening 42 in the sink deck. The side spray has a threaded conduit 44, with an unthreaded portion 46 directly beneath the escutcheon 40. The extension nut of the present invention will be used in a manner such that surface 30 will abut the underside of the sink deck. The radial extension 22 may be lobular in form, as particularly shown in FIG. 3, having a plurality of arcuate segments 48 separated by indentations 50. Such a lobular design facilitates hand installation of the extension nut. The nut will be threaded onto the conduit 44 and will be turned until the surface 30 abuts the underside of the sink deck. This will provide a secure attachment for the side spray to the sink deck.

In the use illustrated in FIG. 2, the radial surface 24 abuts the underside of the sink deck and this use is particularly adapted for sink decks which may be 1" or less in thickness. Again, the extension nut will be threaded onto a conduit 52, with the body of the extension nut extending away from the sink deck, whereas, in the FIG. 1 use the body of the extension nut extends toward the sink deck and in fact extends within the bore 42. In the FIG. 2 illustration, the surface 24 abuts the underside of the sink deck and a recess 54 formed in the radial extension 22 accommodates the unthreaded portion 46 of the threaded conduit 44. As an example, the recess may have a depth of approximately 0.150 to accommodate the unthreaded portion of the side spray conduit.

Whereas the preferred form of the invention has been shown and described herein, it should be realized that there may be many modifications, substitutions and alterations thereto.

What is claimed is:

1. In combination:

a dual position fastener and a plumbing fitting having an exteriorly threaded conduit for connecting said fitting to sink decks of varying thickness, said fastener including an elongated, generally cylindrical body having an interior bore, which bore is threaded throughout substantially the entire length of the body, a radial extension at one end of said elongated generally cylindrical body, said radial extension having oppositely facing generally parallel surfaces, which surfaces are essentially normal to the axis of said bore, one of said surfaces being at and forming one end of said fastener, with the other of said surfaces being axially spaced from said one end and located generally intermediate said one end and another end of said cylindrical body, each radial surface being located to abut the underside of a sink deck when the fastener is used in attaching the plumbing fitting to the sink deck, said radial extension having a radial portion which includes said one radial surface, said radial extension having an axial portion, spaced radially from said body, which axial portion extends from the outermost portion of said radial portion toward the other end of said cylindrical body, with said other radial surface being at one end of said axial portion, and a recess adjacent said bore and located at one end of said fastener, wherein, when said threaded conduit is received through a hole in a sink deck such that it extends below the underside thereof, said one radial surface abuts the underside of the sink deck and said elongated body extends away from the sink deck on said threaded conduit, and when said threaded conduit is similarly received in another sink deck having a second thickness, said other radial surface abuts the underside of the sink deck and the elongated body extends toward the sink deck.

2. The combination of claim 1 wherein the thread on said interior bore is discontinuous and formed of diametrically opposed arcuate thread segments.

3. The combination of claim 1, wherein said radial extension, including said axial portion, has a plurality of uniform arcuate segments separated by indentations.

* * * * *